US008054286B2

(12) United States Patent
Feng

(10) Patent No.: US 8,054,286 B2
(45) Date of Patent: Nov. 8, 2011

(54) LIQUID CRYSTAL DISPLAY CAPABLE OF ADJUSTING BRIGHTNESS OF BACKLIGHT THEREOF AND METHOD FOR DRIVING SAME

(75) Inventor: Sha Feng, Shenzhen (CN)

(73) Assignees: Innocom Technology (ShenZhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 743 days.

(21) Appl. No.: 12/214,134

(22) Filed: Jun. 16, 2008

(65) Prior Publication Data

US 2008/0309603 A1 Dec. 18, 2008

(30) Foreign Application Priority Data

Jun. 15, 2007 (CN) ..... 2007 1 0075053

(51) Int. Cl.
*G09G 3/36* (2006.01)

(52) U.S. Cl. ..... 345/102

(58) Field of Classification Search ..... 345/102, 345/87, 204, 690
See application file for complete search history.

(56) References Cited

U.S. PATENT DOCUMENTS

| | | | | |
|---|---|---|---|---|
| 6,297,791 | B1 * | 10/2001 | Naito et al. | 345/89 |
| 7,113,164 | B1 * | 9/2006 | Kurihara | 345/102 |
| 7,768,495 | B2 * | 8/2010 | Hong et al. | 345/102 |
| 2005/0001801 | A1 | 1/2005 | Kim | |
| 2007/0001997 | A1 * | 1/2007 | Kim et al. | 345/102 |

* cited by examiner

*Primary Examiner* — Stephen Sherman
(74) *Attorney, Agent, or Firm* — Altis Law Group, Inc.

(57) ABSTRACT

An exemplary liquid crystal display (20) includes a liquid crystal panel (27) having at least one pixel block, a source driver (26) configured to drive the at least one pixel block, a backlight module having at least one light source block, a backlight driver (23) configured to drive the light source blocks, and a data processor (21) configured to provide gray level values and provide backlight control signals. The data processor receives display signals, converts the display signals to a plurality of primary gray level values, and averages the primary gray level values to obtain an average gray level value. The source driver and the backlight driver respectively generate data voltages and driving voltages to drive the at least one pixel block and the at least one pixel block according to the average gray level value. A related method for driving the liquid crystal display is also provided.

20 Claims, 6 Drawing Sheets

| average gray level value | first brightness adjusting coefficient | second brightness adjusting coefficient | third brightness adjusting coefficient |
|---|---|---|---|
| 0 ~ 63 | 1/4 | 1/5 | 1/4 |
| 64 ~ 127 | 2/4 | 2/5 | 2/4 |
| 128 ~ 191 | 3/4 | 4/5 | 3/4 |
| 192 ~ 255 | 1 | 1 | 1 |

| subtraction result D | gray level adjusting coefficient |
|---|---|
| $D < -30$ | 1/1.15 |
| $-30 \leqslant D < -20$ | 1/1.1 |
| $-20 \leqslant D < -10$ | 1/1.05 |
| $-10 \leqslant D < 10$ | 1 |
| $10 \leqslant D < 20$ | 1.07 |
| $20 \leqslant D < 30$ | 1.10 |
| $D \geqslant 30$ | 1.15 |

FIG. 8

LIQUID CRYSTAL DISPLAY CAPABLE OF ADJUSTING BRIGHTNESS OF BACKLIGHT THEREOF AND METHOD FOR DRIVING SAME

FIELD OF THE INVENTION

The present invention relates to an LCD capable of adjusting a brightness of a backlight thereof, and to a method for driving the LCD.

GENERAL BACKGROUND

LCDs are widely used in various electronic information products, such as notebooks, personal digital assistants, video cameras, and the like. A conventional LCD usually employs a liquid crystal panel to display images. The liquid crystal panel contains a layer of liquid crystal for generating images. However, the liquid crystal does not generate light itself. Therefore a light source such as a backlight module or ambient light is needed to illuminate the liquid crystal in the liquid crystal panel.

During operation of a conventional LCD, invariable driving voltage signals are stably provided to light sources of a backlight module. This enables the light sources to continuously emit light beams to the liquid crystal panel. Liquid crystal molecules in the liquid crystal panel tilt to corresponding angles according to display signals applied to pixels units that span the layer of liquid crystal. Therefore the amount of light beams transmitting through the liquid crystal molecules at each pixel unit is controlled. The aggregation of light beams transmitting through all the pixel units simultaneously constitutes an image displayed on a screen of the liquid crystal panel.

When the LCD displays a dark image, a so-called gray level of the displayed image is relative low. Only a small amount of light beams are needed to generate a dark image. However, because the driving voltage signals provided to the light sources are invariable, therefore the amount of light beams emitted by the light sources is also invariable. In this circumstance, many or most of the light beams may be unused and simply wasted. That is, the light utilization efficiency of the LCD is low. In addition, when the LCD displays a black image, the liquid crystal molecules at the pixel units of the liquid crystal panel may be influenced by ambient interfering electrical signals. When this happens, the liquid crystal molecules at the pixel units may not be capable of completely blocking transmission of all the light beams incident thereon. This is liable to induce a so-called light leakage phenomenon, whereby a contrast ratio of the LCD may become unsatisfactory.

What is needed is to provide an LCD and a method for driving the LCD that can overcome the above-described deficiencies.

SUMMARY

In a first aspect, a liquid crystal display includes a liquid crystal panel having at least one pixel block, a source driver configured to drive the at least one pixel block to display images, a backlight module having at least one light source block, a backlight driver configured to drive the light source blocks to illuminate, and a data processor configured to provide gray level values to the source driver and provide backlight control signals to the backlight driver. The data processor receives display signals corresponding to the at least one pixel block, converts the display signals to a plurality of primary gray level values, and averages the primary gray level values to obtain an average gray level value. The source driver and the backlight driver respectively generate data voltages and driving voltages to drive the at least one pixel block and the at least one pixel block according to the average gray level value.

In a second aspect, a method for driving a liquid crystal display is provided. The liquid crystal display includes a liquid crystal panel having at least one pixel block, and a backlight module having at least one light source block. The method includes: receiving display signals corresponding to the at least one pixel block; converting the display signals to a plurality of primary gray level values; averaging the primary gray level values to obtain an average gray level value; generating data voltages to drive the at least one pixel block according to the average gray level value; and generating driving voltages to drive the at least one light source block according to the average gray level value.

Other novel features and advantages will become more apparent from the following detailed description when taken in conjunction with the accompanying drawings.

BRIEF DESCRIPTION OF THE DRAWINGS

FIG. 8 is a schematic diagram of the second look up table of the data processor of FIG. 2, illustrating a relationship between a subtraction value and a gray level adjusting coefficient, the subtraction value being obtained by subtracting the average gray level value from a primary gray level value.

DETAILED DESCRIPTION OF PREFERRED EMBODIMENTS

Figure 1:
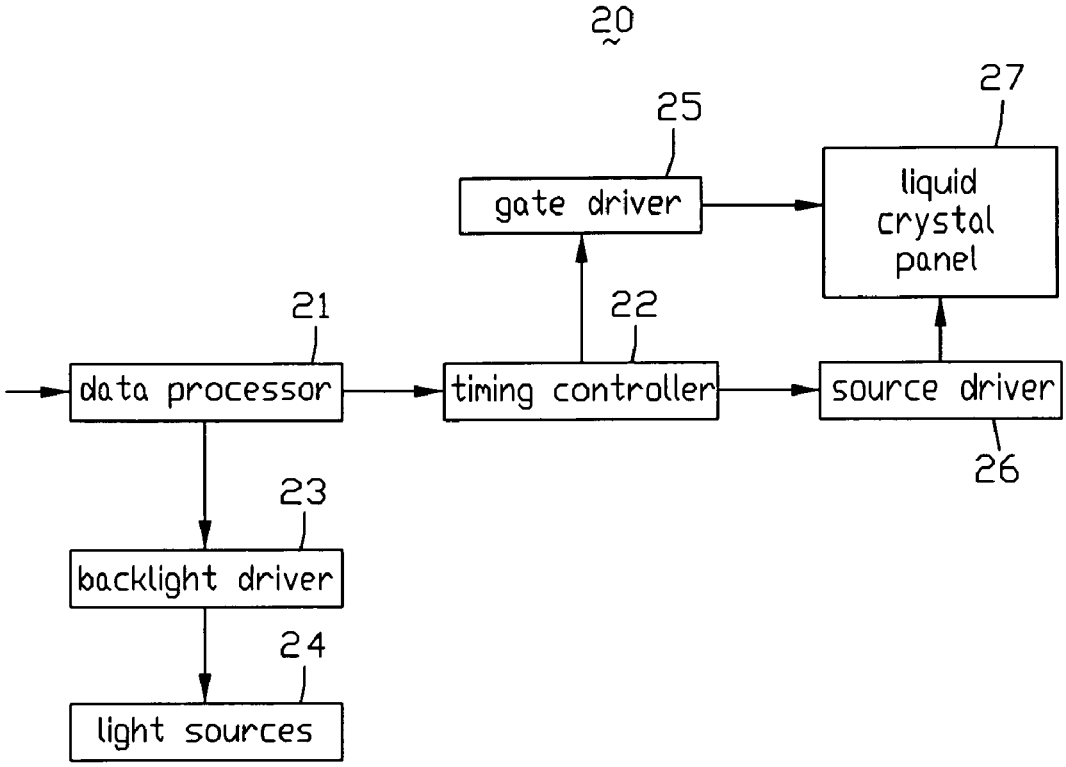
FIG. 1 is a block diagram of an LCD according to an exemplary embodiment of the present invention, the LCD including a data processor.

Reference will now be made to the drawings to describe preferred and exemplary embodiments of the present invention in detail FIG. 1 is a block diagram of an LCD according to an exemplary embodiment of the present invention. The LCD 20 includes a data processor 21, a timing controller 22, a backlight driver 23, a plurality of light sources 24, a gate driver 25, a source driver 26, and a liquid crystal panel 27.

The liquid crystal panel 27 includes a plurality of pixel units (not shown) arranged in a matrix. The matrix of pixel units is divided into a plurality of groups of pixel units. Each group of pixel units is referred to herein as a "pixel block." Each pixel block has a respective address code. For example, a physical resolution of the liquid crystal panel 27 may be 1024×768. That is, the liquid crystal panel 27 includes 1024×768 pixel units arranged in a matrix having 1024 rows and 768 columns. In the liquid crystal panel 27, 256×256 pixel units are defined as a pixel block, and thereby the liquid crystal panel 27 is divided into 4×3 pixel blocks.

The data processor 21 is configured to receive display signals from an external circuit (not shown) frame by frame, and generate a backlight control signal and a plurality of gray level values according to the display signals.

The timing controller 22 is configured to control driving timings of the gate driver 25 and the source driver 26, and to transmit the gray level values outputted by the data processor 21 to the source driver 26. The gate driver 25 is configured to provide a plurality of scanning signals to activate the pixel units of the liquid crystal panel 27. The source driver 26 is configured to provide data voltages to the pixel units according to the gray level values.

The backlight driver 23 is configured to provide driving voltages to the light sources 24 according to the backlight control signal outputted by the data processor 21, so as to enable the light sources 24 to provide illumination for the liquid crystal panel 27. The light sources 24 are arranged as a light emitting diode array including a plurality of red light emitting diodes (RLEDs), a plurality of green light emitting diodes (GLEDs), and a plurality of blue light emitting diodes (BLEDs). The RLEDs, the GLEDs, and the BLEDs are arranged regularly and separately, and cooperatively form a plurality of groups of LEDs. Each group of LEDs is referred to herein as an "LED block." Each LED block corresponds to a respective one of the pixel blocks, and all the LED blocks cooperatively form a backlight module disposed under (or behind) the liquid crystal panel 27.

Figure 2:
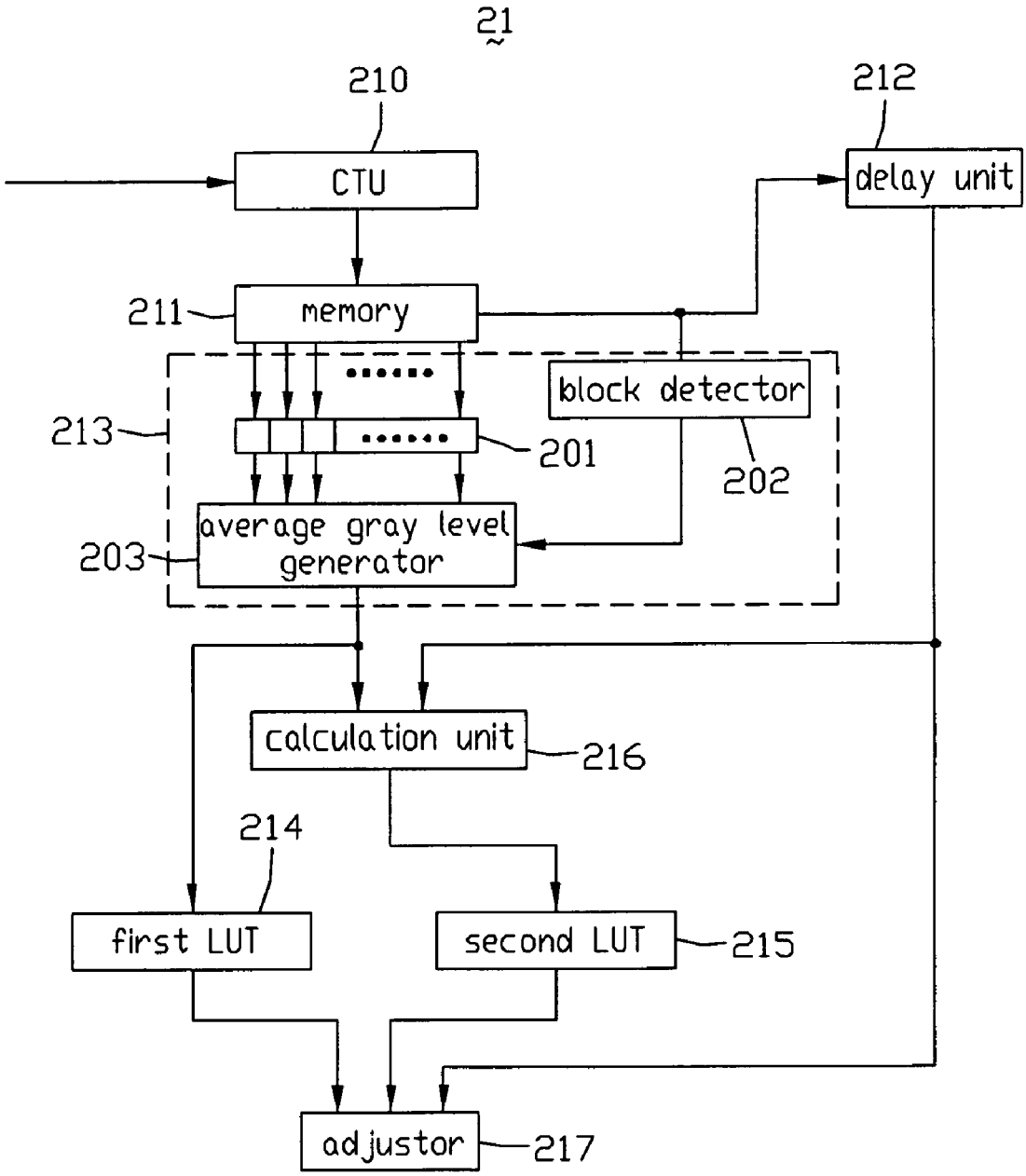
FIG. 2 is a block diagram of the data processor of FIG. 1, the data processor including a first look up table and a second look up table.

Referring to FIG. 2, the data processor 21 includes a color transform unit (CTU) 210, a memory 211, a delay unit 212, a gray level analyzer 213, a first look up table (LUT) 214, a second LUT 215, a calculation unit 216, and an adjustor 217.

The CTU 210 is configured to convert the display signals to corresponding primary gray level values. The memory 211 is configured to store the primary gray level values. The delay unit 212 is configured to delay the primary gray level values for a predetermined period of time before outputting the primary gray level values to the calculation unit 216 and the adjustor 217.

The gray level analyzer 213 is configured to analyze the primary gray level values corresponding to each pixel block, and correspondingly generate an average gray level value. The gray level analyzer 213 includes a gray level register 201, a block detector 202, and an average gray level generator 203. The gray level register 201 includes a plurality of block register units (not labeled), each of which is configured to receive and store the primary gray level values corresponding to a respective one of the pixel blocks. The block detector 202 is configured to detect an address code of the corresponding pixel block, and correspondingly generate a selection control signal. The average gray level generator 203 is configured to select the primary gray level values corresponding to the pixel block from the corresponding block register unit according to the selecting control signal, and generate an average gray level value of the pixel block by averaging the selected primary gray level values.

The first LUT 214 is configured to generate a group of brightness adjusting coefficients for the light sources 24 according to the average gray level value. The calculation unit 216 can for example be a subtraction unit configured to carry out a subtraction calculation between the average gray level value and each of the primary gray level values. The second LUT 215 is configured to generate a gray level adjusting coefficient for each pixel unit of the corresponding pixel block according to a result of the subtraction calculation. The adjustor 217 includes a brightness adjusting unit (not shown) and a gray level adjusting unit (not shown). The brightness adjusting unit is configured to adjust a group of primary brightness control signals of a corresponding one of the LED blocks based on the group of brightness adjusting coefficients. The gray level adjusting unit is independent from the brightness adjusting unit, and is configured to adjust the primary gray level value corresponding to each pixel unit of the pixel block based on the gray level adjusting coefficient, so as to generate and output a plurality of adjusted gray level values for the pixel block.

Figure 3:
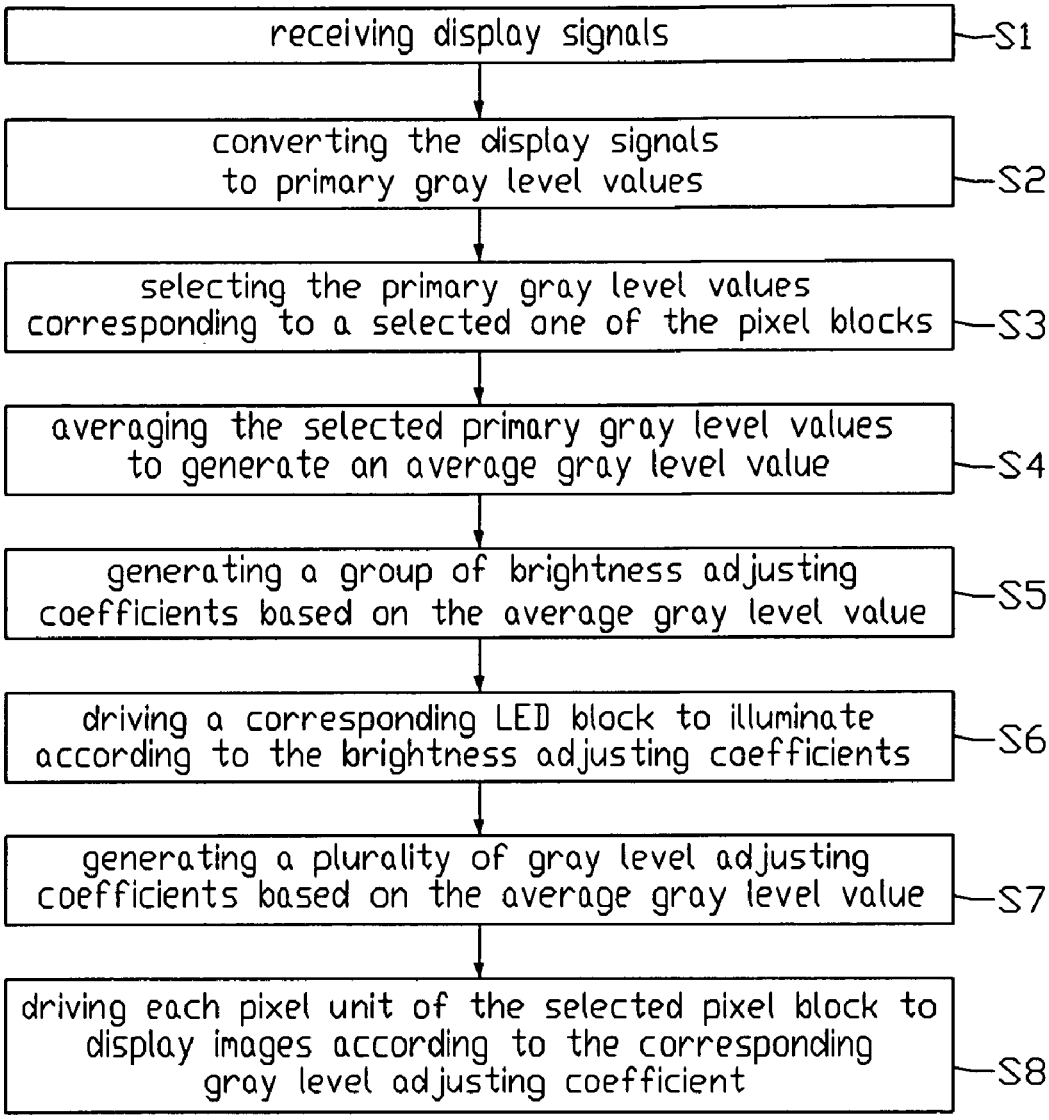
FIG. 3 is a flow chart of an exemplary method for driving the LCD of FIG. 1, the method including steps S1-S8.

Typically, the LCD 20 can be driven via a exemplary driving method as summarized in FIG. 3. Referring to FIG. 3, the exemplary driving method includes: step S1, receiving display signals; step S2, converting the display signals to primary gray level values; step S3, selecting the primary gray level values corresponding to a selected one of the pixel blocks; step S4, averaging the selected primary gray level values to generate an average gray level value; step S5, generating a group of brightness adjusting coefficients based on the average gray level value; step S6, driving a corresponding LED block to illuminate according to the brightness adjusting coefficients; step S7, generating a plurality of gray level adjusting coefficients based on the average gray level value; and step S8, driving each pixel unit of the selected pixel block to display according to the corresponding gray level adjusting coefficient.

In step S1, the display signals are received by the data processor 21 from the external circuit. The display signals correspond to a frame of an image to be displayed by the liquid crystal panel 27. Each of the display signals is an 8-bit digital signal, and corresponds to a respective pixel unit.

In step S2, the display signals are converted to a plurality of primary gray level values by the CTU 210. In detail, each of the 8-bit digital signals corresponds to a respective one in 256 gray levels. For example, if the 8-bit digital signal is 00000000, it corresponds to the first gray level indicating that a related brightness is the lowest. If the 8-bit digital signal is 11111111, it corresponds to the 256th gray level indicating that a related brightness is the greatest. Moreover, the primary gray level values are further outputted to and stored in the memory 211.

Figures 4, 5:
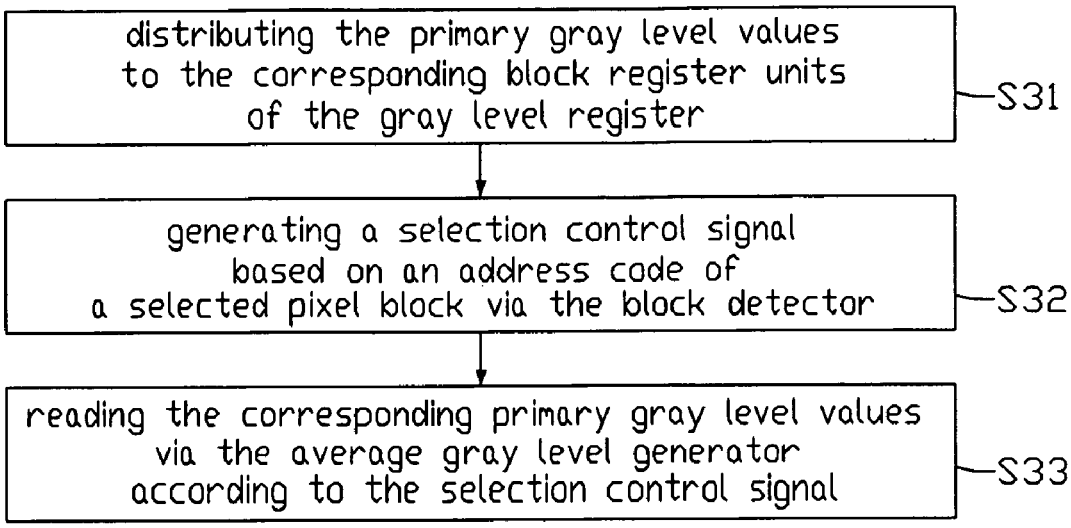
FIG. 4 is a flow chart of detailed processes of step S3 of the method of FIG. 3.
FIG. 5 is a schematic diagram of the first look up table of the data processor of FIG. 2, illustrating a relationship between an average gray level value and a group of brightness adjusting coefficients.

Referring to FIG. 4, step S3 includes: sub-step S31, distributing primary gray level values to the corresponding block register units of the gray level register 201; sub-step S32, generating a selection control signal based on an address code of a selected pixel block via the block detector 202; and sub-step S33, reading the corresponding primary gray level values from the block register units via the average gray level generator 203 according to the selection control signal.

In step S4, the selected primary gray level values are averaged by the average gray level generator 203, and thereby an average gray level value of the selected pixel block is generated.

In step S5, the group of brightness adjusting coefficients is provided by the first LUT 214. In detail, when the average gray level value is received by the first LUT 214, the first LUT 214 outputs a corresponding group of brightness adjusting coefficients to the brightness adjusting unit of the adjustor 217. The group of brightness adjusting coefficients includes a first brightness adjusting coefficient corresponding to the RLEDs of the LED block, a second brightness adjusting coefficient corresponding to the GLEDs of the LED block, and a third brightness adjusting coefficient corresponding to the BLEDs of the LED block.

Referring to FIG. 5, a relationship between the average gray level and the group of brightness adjusting coefficients is shown. In detail, when the average gray level value is in a range from 0 to 63, the first, second, and third brightness adjusting coefficients are respectively equal to ¼, ⅕, and ¼. When the average gray level value is in a range from 64 to 127, the first, second, and third brightness adjusting coefficients are respectively equal to ¾, ⅖, and ¾. When the average gray level value is in a range from 128 to 191, the first, second, and third brightness adjusting coefficients are respectively equal to ¾, ⅘, and ¾. When the average gray level value is in a range from 192 to 255, the first, second, and third brightness adjusting coefficients are all equal to 1.

Figure 6:
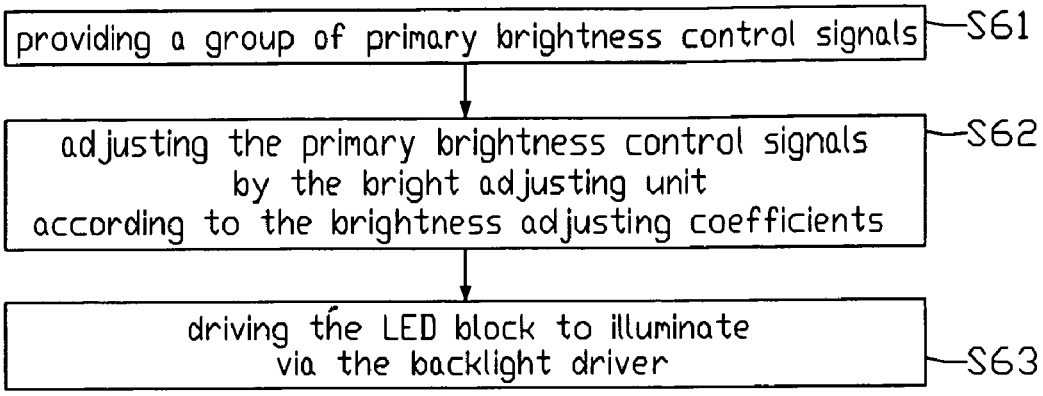
FIG. 6 is a flow chart of detailed processes of step S6 of the method of FIG. 3.

Referring to FIG. 6, step S6 includes: sub-step S61, providing a group of primary brightness control signals; sub-step S62, adjusting the primary brightness control signals by the bright adjusting unit according to the brightness adjusting coefficients; and sub-step S63, driving the LED block to illuminate by the backlight driver 24.

In sub-step S61, the group of primary brightness control signals are provided in the brightness adjusting unit. The group of primary brightness control signals includes a first brightness control signal configured to control the brightness of the RLEDs, a second brightness control signal configured to control the brightness of the GLEDs, and a third brightness control signal configured to control the brightness of the BLEDs. In addition, the first, second, and third brightness control signals correspond to the first, second, and third brightness adjusting coefficients respectively.

In sub-step S62, each of the primary brightness control signals is adjusted by the brightness adjusting unit by multiplying the primary brightness control signal by a corresponding one of the brightness adjusting coefficients. The adjusted group of brightness control signals serves as a backlight control signal, and is outputted to the backlight driver 23.

In sub-step S63, a group of driving voltages are provided by the backlight driver 23 according to the backlight control signal, and the RLEDs, the GLEDs, and the BLEDs of the LED block are then driven by the driving voltages and provide illumination for the corresponding pixel block. Due to the brightness adjusting coefficients, when an image element to be displayed by the corresponding pixel block is relatively dark, the brightness of the LED block decreases. That is, an amount of light beams provided by the LED block is reduced.

Figure 7:
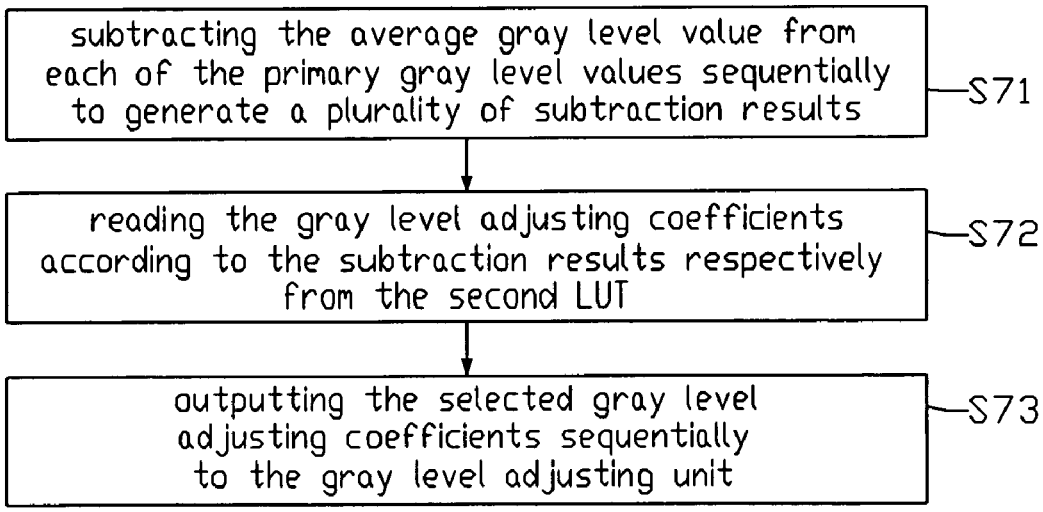
FIG. 7 is a flow chart of detailed processes of step S7 of the method of FIG. 3.

Referring to FIG. 7, step S7 includes: sub-step S71, subtracting the average gray level value from each of the primary gray level values sequentially to generate a plurality of subtraction results; sub-step S72, reading corresponding gray level adjusting coefficients according to the subtraction results respectively from the second LUT 215; and sub-step S73, outputting the selected gray level adjusting coefficients sequentially to the gray level adjusting unit.

In sub-step S71, the calculation unit 216 receives the primary gray level values and the average gray level value, and carries out the subtraction calculation therein.

Referring to FIG. 8, in sub-step S72, a relationship between the subtraction result and the gray level adjusting coefficient is shown. In detail, when the subtraction result D is less than −30, the gray level adjusting coefficient is equal to 1/1.15. When the subtraction result D satisfies $-30 \leqq D < -20$, the gray level adjusting coefficient is equal to 1/1.1. When the subtraction result D satisfies $-20 \leqq D < -10$, the gray level adjusting coefficient is equal to 1/1.05. When the subtraction result D satisfies $-10 \leqq D < 10$, the gray level adjusting coefficient is equal to 1. When the subtraction result D satisfies $10 \leqq D < 20$, the gray level adjusting coefficient is equal to 1.07. When the subtraction result D satisfies $20 \leqq D < 30$, the gray level adjusting coefficient is equal to 1.1. When the subtraction result D is greater than or equal to 30, the gray level adjusting coefficient is equal to 1.15.

In sub-step S73, the second LUT 215 outputs the selected gray level adjusting coefficients to the gray level adjusting unit of the adjustor 217 sequentially.

In step S8, firstly, each of the primary gray level values is adjusted in the gray level adjusting unit by multiplying the primary gray level value by the corresponding gray level adjusting coefficient. Due to the gray level adjusting coefficient, when a color displayed by the pixel unit is relatively bright, the gray level of the pixel unit increases. When a color displayed by the pixel unit is relatively dark, the gray level of the pixel unit decreases. Secondly, the adjusted primary gray level values are outputted to the source driver 26 via the timing controller 22, and converted to corresponding data voltages by the source driver 26. Thirdly, the data voltage, together with scanning signals provided by the gate driver 25, cooperatively drive the pixel units of the pixel block to display a corresponding image element.

Moreover, the driving method further includes sequentially repeating steps S3-S8 a plurality of times, so as to drive the remaining pixel blocks and the corresponding LED blocks in much the same way as described above in relation of the one pixel block.

In the LCD 20, the data processor 21 is employed to calculate an average gray level value of each pixel block, to adjust the gray level value of the pixel block, and to generate the backlight control signal for the corresponding LED block according to the average gray level value. The backlight driver 23 drives the light sources 24 according to the backlight control signal, and thereby the amount of light beams provided by the light sources 24 is variable according to changes in the backlight control signal. Thus when the pixel block displays a dark image element, the amount of light beams provided by the light sources 24 drops. Wastage of light beams is reduced, and the light utilization efficiency of the LCD 20 is improved. Moreover, when the LCD displays a black image, because few light beams are provided by the light sources 24, any light leakage phenomenon is weakened. Thereby, the contrast ratio of the LCD 20 is improved.

Furthermore, the gray level of each pixel unit is adjusted by the data processor 21. That is, when the color displayed by the pixel unit is relatively bright, the gray level of the pixel unit increases; and when the color displayed by the pixel unit is relatively dark, the gray level of the pixel unit decreases. The LCD 20 is capable of adjusting a gray level of each pixel unit according to a brightness thereof. Thus a display quality of the LCD 20 is further improved.

In alternative embodiments, the matrix of pixel units in the liquid crystal panel 27 can be divided any other desired number of pixel blocks. In another example, all the pixel units can serve as an entire single pixel block.

It is to be further understood that even though numerous characteristics and advantages of preferred and exemplary embodiments have been set out in the foregoing description, together with details of structures and functions associated with the embodiments, the disclosure is illustrative only; and that changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel comprising at least one pixel block;

a source driver configured to drive the at least one pixel block to display images;

a backlight module comprising at least one light source block;

a backlight driver configured to drive the at least one light source block to emit light; and a data processor configured to provide gray level values to the source driver and provide a backlight control signal to the backlight driver;

wherein the data processor is configured to receive display signals corresponding to the at least one pixel block, convert the display signals to a plurality of primary gray level values, and average the primary gray level values to obtain an average gray level value, the source driver and the backlight driver are configured to respectively generate data voltages and driving voltages to drive the at least one pixel block and the at least one light source block according to the average gray level value;

wherein the data processor comprises a calculation unit and a look up table, the calculation unit is configured to carry out a predetermined calculation by applying the average gray level value to each primary gray level value of the at least one pixel block, the calculation is subtracting the average gray level value from each primary gray level value of the at least one pixel block, and the look up table comprises a plurality of gray level adjusting coefficients, each of which corresponds to a result of the subtraction of the average gray level value from each primary gray level value of the at least one pixel block.

2. The liquid crystal display of claim 1, wherein the data processor comprises a color transform unit and a memory, the color transform unit is configured to convert the display signals to the primary gray level values, and the memory is configured to store the primary gray level values.

3. The liquid crystal display of claim 2, wherein the at least one pixel block is a plurality of the pixel blocks, and each of the pixel blocks corresponds to a respective address code.

4. The liquid crystal display of claim 3, wherein the data processor further comprises a gray level analyzer configured to provide the average gray level value of each of the pixel blocks.

5. The liquid crystal display of claim 4, wherein the gray level analyzer comprises a gray level register having a plurality of block register units, and the primary gray level values of each pixel block are distributed to a respective block register unit from the memory.

6. The liquid crystal display of claim 5, wherein the gray level analyzer further comprises a block detector and an average gray level generator, the block detector detects an address code of a corresponding pixel block and thereby generates a selection control signal, the average gray level generator reads the primary gray level values from a selected one of the block register units according to the selection control signal, and generates the average gray level value by averaging the selected primary gray level values.

7. The liquid crystal display of claim 1, wherein the data processor further comprises another look up table comprising a plurality of groups of brightness adjusting coefficients, and each group of brightness adjusting coefficients correspond to the average gray level value.

8. The liquid crystal display of claim 7, wherein the data processor further comprises a brightness adjusting unit, and the brightness adjusting unit is configured to provide a group of primary brightness control signals, adjust the primary brightness control signals according to the corresponding brightness adjusting coefficients and thereby generate the backlight control signal, and transmit the backlight control signal to the backlight driver.

9. The liquid crystal display of claim 1, wherein the data processor further comprises a gray level adjusting unit, and the gray level adjusting unit is configured to adjust each primary gray level value of the at least one pixel block according to the corresponding gray level adjusting coefficient, and output the adjusted gray level value to the data driver.

10. The liquid crystal display of claim 9, wherein the data processor further comprises a delay unit, and the delay unit is configured to delay handling of the primary gray level values for a predetermined period of time before outputting the primary gray level values to the calculation unit and the gray level adjusting unit.

11. A method for driving a liquid crystal display, the liquid crystal display comprising a liquid crystal panel having at least one pixel block, and a backlight module having at least one light source block, the at least one pixel block each corresponding to a respective address code, the method comprising:

receiving display signals corresponding to the at least one pixel block;

converting the display signals to a plurality of primary gray level values;

selecting the primary gray level values of one of the at least one pixel block, comprising:

providing at least one block register unit each corresponding to a respective one of the at least one pixel block; distributing the primary gray level values to a corresponding block register unit; generating a selection control signal based on an address code of the selected pixel block; and selecting the corresponding primary gray level values from the at least one block register unit according to the selection control signal;

averaging the selected primary gray level values to obtain an average gray level value;

generating data voltages to drive the at least one pixel block according to the average gray level value; and generating driving voltages to drive the at least one light source block according to the average gray level value.

12. The method of claim 11, wherein the generating of data voltages comprises: carrying out a predetermined calculation by applying the average gray level value to each of the primary gray level values to obtain a plurality of calculation results; reading a corresponding gray level adjusting coefficient according to the calculation results from a look up table; adjusting each of the primary gray level values according to the gray level adjusting coefficient, and generating the data voltages according to the adjusted gray level values.

13. The method of claim 11, wherein the predetermined calculation comprises subtracting the average gray level value from each of the primary gray level values.

14. The method of claim 11, wherein the generating of driving voltages comprises: reading a corresponding group of brightness adjusting coefficients according to the average gray level value from a look up table; providing a group of primary brightness control signals; adjusting the primary brightness control signals according to the brightness adjusting coefficients; and generating the driving voltages according to the adjusted brightness control signals.

15. A liquid crystal display, comprising:

a liquid crystal panel comprising a plurality of pixel blocks, each of the pixel blocks corresponding a respective address code;

a source driver configured to drive the plurality of pixel blocks to display images;

a backlight module comprising a plurality of light source blocks;

a backlight driver configured to drive the plurality of light source blocks to emit light; and a data processor configured to receive display signals corresponding to the pixel blocks, convert the display signals to a plurality of primary gray level values, and average the primary gray level values to obtain an average gray level value, wherein the data processor comprises a gray level analyzer configured to provide the average gray level value of each of the pixel blocks, the gray level analyzer comprises a gray level register including a plurality of block register units, a block detector and an average gray level generator, the primary gray level values of each pixel block are distributed to a respective block register unit, the block detector detects an address code of a corresponding pixel block and thereby generates a selection control signal, the average gray level generator reads the primary gray level values from a selected one of the block register units according to the selection control signal, and generates the average gray level value by averaging the selected primary gray level values, the source driver and the backlight driver are configured to respectively generate data voltages and driving voltages to drive the pixel blocks and the light source blocks according to the average gray level value.

16. The liquid crystal display of claim 15, wherein the data processor comprises a color transform unit and a memory, the color transform unit is configured to convert the display signals to the primary gray level values, and the memory is configured to store the primary gray level values.

17. The liquid crystal display of claim 15, wherein the data processor further comprises a first look up table, the first look up table comprises a plurality of groups of brightness adjusting coefficients, and each group of brightness adjusting coefficients corresponding correspond to the average gray level value.

18. The liquid crystal display of claim 17, wherein the data processor further comprises a brightness adjusting unit, and the brightness adjusting unit is configured to provide a group of primary brightness control signals, adjust the primary brightness control signals according to the corresponding brightness adjusting coefficients and thereby generate a backlight control signal, and transmit the backlight control signal to the backlight driver.

19. The liquid crystal display of claim 18, wherein the data processor comprises a calculation unit configured to carry out a predetermined calculation by applying the average gray level value to each primary gray level value of the pixel blocks, and the calculation is subtracting the average gray level value from each primary gray level value of the pixel blocks.

20. The liquid crystal display of claim 19, wherein the data processor comprises a second look up table, and the second look up table comprises a plurality of gray level adjusting coefficients, each of which corresponds to a result of the subtraction of the average gray level value from each primary gray level value of the pixel blocks.

* * * * *